United States Patent [19]

Cohn

[11] 4,044,778

[45] Aug. 30, 1977

[54] CIGARETTES

[76] Inventor: Charles C. Cohn, c/o Colonial Alloys Company, 4041 Ridge Ave., Bldg. No. 11, Philadelphia, Pa. 19129

[21] Appl. No.: 395,650

[22] Filed: Sept. 10, 1973

[51] Int. Cl.[2] ..... A24D 1/02

[52] U.S. Cl. ..... 131/4 A; 131/15 R

[58] Field of Search ..... 131/4 A, 15 B, 4 R, 131/4 B, 15, 8 R, 264

[56] References Cited

U.S. PATENT DOCUMENTS

| | | | |
|---|---|---|---|
| 1,946,203 | 2/1934 | Gabriel | 131/15 A X |
| 1,996,002 | 3/1935 | Seaman | 131/4 A |
| 2,272,206 | 2/1942 | Jacobowitz | 131/12 |
| 2,580,609 | 9/1952 | Schur | 131/15 |
| 2,985,175 | 5/1961 | Rich | 131/4 A |
| 3,006,347 | 10/1961 | Keaton | 131/15 R |
| 3,030,963 | 11/1960 | Cohn | 131/15 A X |
| 3,313,305 | 4/1967 | Noznick | 131/264 |

FOREIGN PATENT DOCUMENTS

| | | | |
|---|---|---|---|
| 909,699 | 10/1962 | United Kingdom | 131/15 A |

OTHER PUBLICATIONS

9th Annual Addition, "The Worst from Mad," 5/3/66 by Al Jaffee (Mad Magazine, pp. 71–73).

*Primary Examiner*—Robert W. Michell
*Assistant Examiner*—V. Millin
*Attorney, Agent, or Firm*—Smith, Harding, Earley & Follmer

[57] ABSTRACT

A self-extinguishing cigarette particularly when in contact with a flammable surface wherein the wrapper which encloses the body of tobacco is provided with a coating deposited from an aqueous solution of an alkali silicate. The silicate solution contains from about 17 to 27 percent by weight of $SiO_2$. The coating area of the silicate solution on the wrapper is from about 40 to 84 percent of the entire outside wrapper area. The silicate solution may have added thereto various beneficial additives such as acids, carbohydrates, colloids, humectants, fire retardent compounds, alumina gel compounds, or compatible compounds of the aforesaid additives.

18 Claims, 3 Drawing Figures

CIGARETTES

BACKGROUND OF THE INVENTION

This invention relates generally to self-extinguishing cigarettes. More particularly, the cigarette in accordance with the invention is of the type disclosed in my U.S. Pat. No. 3,030,963 dated Apr. 24, 1962.

While the cigarette of my prior patent is fire resistant, this fire resistance depends essentially on the elevation of the cigarette from the surface on which it is placed, this being caused by the intumescence of the dried silicate which foams up under the heat of a burning cigarette. However, the cigarette in accordance with my prior patent does not self-extinguish.

SUMMARY OF THE INVENTION

It is an object of this invention to provide a cigarette which has a coating thereon such that the cigarette will self-extinguish when in contact with a surface after a predetermined time and still be an acceptable cigarette for smoking pleasure.

Another object of this invention is to provide a cigarette which substantially lowers the volume of smoke given off by a burning cigarette between puffs or while it is burning free in air.

Another object of the invention is to provide a cigarette which is stiffer and less breakable than prior cigarettes.

A further object of the invention is to provide a cigarette which consumes less tobacco when compared to a conventional cigarette based on the same amount of puffs.

The above objects are achieved by the cigarette construction having a body of tobacco enclosed by a combustible wrapper, a heat insulating coating on said wrapper deposited from an aqueous solution of a soluble alkali silicate containing from about 17 to 27 percent by weight of $SiO_2$, the coating area of the silicate solution on the wrapper being from about 40 to 84 percent of the entire wrapper area to produce a cigarette which is self-extinguishing.

Another feature of the invention is that the silicate coating in accordance with the invention has the property of retaining the moisture that is normally contained in the cigarette to thereby maintain an equilibrium of freshness over a longer period of storage, nonuse or the like.

Another feature of the invention is to improve the quality of the coating applied to the cigarette by adding to the silicate solution one or more of the following additives:

a. One or more soluble or dispersible carbohydrates;
b. One or more soluble acids or acidic compounds;
c. Certain colloids or humectants;
Small amounts of fire retardant compounds;
e. Small amounts of liquid alumina gel.

The manner in which the above additives improve the quality of the cigarette will be described in detail in the specification. Briefly these improvements are as follows:

1. More flexible silicate coating lines or dots;
2. Less tendency of silicate coating lines or dots on the cigarette paper to cause the packed cigarettes to stick to one another and less tendency of the cigarette papers to stick or block on the bobbin during manufacture;
3. The taste and flavor of the puff are improved;

4. Less residual oral odors after smoking;
5. Less "wicking" or spreading of the silicate solution when applied to the cigarette paper;
6. Better appearance of the silicate coating;
7. Longer burning time in air between puffs.

DESCRIPTION OF THE PREFERRED EMBODIMENT

All percentages given in the specification are in terms of total weight.

The invention is applicable to the commonly employed cigarette structure to which the conventional tobacco filler is wrapped in a paper or a similar combustible wrapper. The invention is also applicable to cigarettes of various lengths, with or without filters, or where combusible materials other than tobacco are used in place of the tobacco.

In accordance with the invention, the wrapper of the cigarette is provided with a coating which in response to the heat of the burning cigarette provides a self-extinguishing cigarette. The invention depends, mainly on the self-extinguishing feature of the burning coal by reason of the slow burning rate of the wrapper and the limited air access to the burning coal as a result of the density of the ash surrounding it. While the cigarette in accordance with the invention may exhibit some intumescence which causes the burning cigarette to raise from contact with the surface upon which it rests, this is only incidental to the invention.

Figure 1:
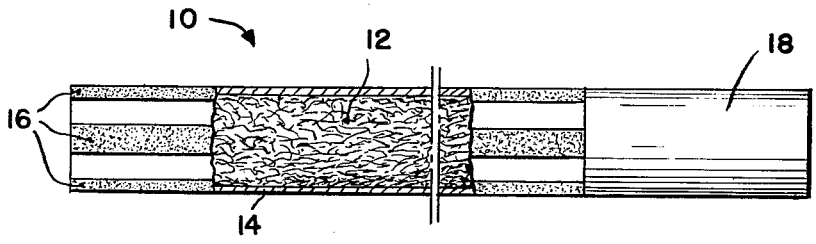
FIG. 1 is a showing of a cigarette having the coating applied along straight lines in accordance with the invention.

The coating may be applied to the cigarette in various configurations. For example, the coating may be applied along spaced parallel straight lines running the length of the tobacco containing portion of the cigarette. This preferred configuration is shown in FIG. 1 wherein a cigarette 10 has a tobacco filler 12 enclosed by a combustible paper wrapper 14 having a silicate coating of spaced parallel straight lines 16 and provided with a filter tip 18. Alternately, the coating may be sinuous lines or some other configuration, such as dots. As will appear hereafter the $SiO_2$ concentrations in the silicate solution will vary somewhat and this may vary the dimensions of the configuration used. Preferably the coating is applied to the side of the wrapper which forms the outside of the cigarette in the finished product although the invention encompasses applying the coating to either side of the cigarette wrapper.

The invention encompasses various configurations of the silicate coating, the essential consideration being that the arrangement of the coating is such that the coating area of the silicate solution on the wrapper covers from about 40 to 84 percent of the entire outside wrapper area so as to achieve the self-extinguishing of the cigarette as will be described more fully hereafter. Accordingly, the wider the lines and the fewer the number of lines, the greater percentage of the wrapper will be covered and a higher concentration of the $SiO_2$ is indicated for the ultimate condition of self-extinguishing and vice versa.

A preferred configuration in accordance with the invention would involve two 8 millimeter wide lines running the length of the cigarette and evenly spaced apart using a concentration of 19.6 to 22.7 percent $SiO_2$ where the silicate covers about 64 percent of the outside wrapper area.

A most preferred configuration in accordance with the invention would involve three 4 millimeter wide straight lines lengthwise, and evenly spaced by three 4.5 millimeter spaces, using a concentration of about 16.8% by weight of $SiO_2$, where the silicate covers about 48% of the surface of the outside of the cigarette wrapper.

The widths of the lines may range from 2 to 8 millimeters which varies inversely with the number of lines which may range from 2 to 6.

The coating is formed by dry deposits of alkali silicate which are printed or otherwise applied onto the cigarette wrapper. The printing procedure is well-known and generally involves the use of the soft roller impression roller of the desired configuration, a pick up roller rotating in a bath of the silicate solution serving to transfer the solution to the impression roller. The application of the silicate may be limited to the areas which in the use of the cigarette involves burning.

The silicate concentration in accordance with the invention comprises an amount of $SiO_2$ solution, as applied, which is between from about 17 to 27 percent by weight.

When the coating is of the type described above, the silicate lines or coatings are not consumed by the burning wrapper and/or tobacco but remain behind in the form of an insulating sheath which permits the wrapper of the burning cigarette to continue burning in the spaces between the silicate lines when not being puffed (in air) for up to about 5 minutes without the addition of liquid alumina gel or up to about 10 minutes or more with the addition of liquid alumina gel. Moreover, the cigarette in accordance with the invention will substantially lower the volume of smoke given off by a burning cigarette between puffs or while it is burning free in air. Furthermore, the cigarette will be stiffer and less breakable. Also, less tobacco will be consumed as compared with an untreated cigarette based on similar smoking conditions.

Furthermore, the burning rate of the cigarette in accordance with the invention will not be less than 0.7 millimeters per minute and not more than 3.5 millimeters per minute while the cigarette is burning free in air without puffing. This compares quite favorably with the burning rate of an average untreated cigarette which is from 4.5 to 6.0 millimeters per minute.

It will be evident that the free burning rate is measured by dividing the burning time in minutes into the length of the tobacco rod consumed (in millimeters) during burning. In a typical conventional untreated cigarette, the cigarette burns its full length. Thus, for example, a 55 millimeter tobacco rod is consumed in about 11 minutes wherefore the burning rate is about 5 millimeters per minute. The cigarettes in accordance with the invention may or may not self-extinguish during the free burning, and if they do extinguish they would have to be relit. In this case the burning rate is calculated by adding together the lengths of burning time and the cigarette length consumed during each burning and taking an average.

It will be noted that the burning rate is less and the fire resistence is greater as a greater amount of the cigarette wrapper is covered by the silicate and as a greater concentration of the $SiO_2$ in the silicate is used.

Typical specific examples of the silicate coatings of this invention, as applied to a conventional cigarette which has a wrapper circumference of 25 millimeters are as follows:

EXAMPLE NO. I

The coating is applied to the wrapper along two parallel straight lines 8 millimeters wide with the two spaces therebetween having a width of 4.5 millimeters to thereby cover 64 percent of the wrapper area. The coating is deposited from a liquid silicate composition containing 19.7 percent $SiO_2$.

EXAMPLE NO. II

The coating is applied to the wrapper along three parallel straight lines which are 7 millimeters wide and are evenly spaced apart with the three spaces being 1.3 millimeters wide to thereby cover 84 percent of the wrapper area. The coating is deposited from a liquid silicate composition containing 17.9 percent $SiO_2$.

EXAMPLE NO. III

The coating is applied to the wrapper along 4 parallel straight lines 3 millimeters wide and spaced apart by four spaces 3.0 millimeters wide to cover 50 percent of the wrapper area. The coating is deposited from a liquid silicate composition containing 23.6 percent $SiO_2$.

EXAMPLE NO. IV

The coating was applied to the wrapper as circular dots having a 6 millimeter diameter with the width of the spaces therebetween approximating 2 millimeters and thereby cover a wrapper area of about 46 percent. The coating is deposited from a liquid silicate composition containing 19.7 percent $SiO_2$.

EXAMPLE NO. V

The coating is applied to the wrapper along six parallel straight lines 2 millimeters in diameter with the six spaces between the lines each being 2.1 millimeters in diameter so that the line areas cover 48 percent of the wrapper area. The lined area coating is deposited from a liquid silicate composition containing 19.7 percent $SiO_2$ and the spaces are deposited from a liquid silicate composition containing 4.9 percent $SiO_2$.

If the coating is supplied to the cigarette in a sinuous configuration, the deviation of the sign curve from the straight line should not be greater than about 45°.

It is noted that the use of parallel straight lines is the preferred form and it is preferred that the lines be evenly spaced from one another.

It is also noted that the spacing between the lines should not be less than 1 millimeter in width.

Figure 2:
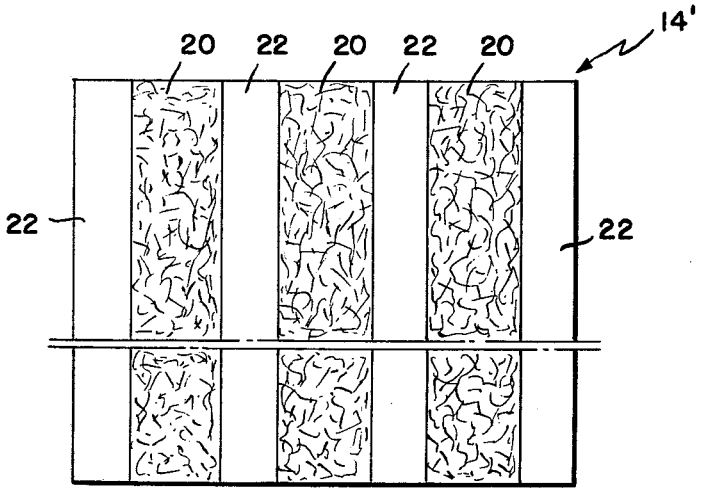
FIG. 2 is a view showing the application of the coating along lines on the cigarette wrapper.

FIG. 2 illustrates a typical arrangement wherein lines are applied to the cigarette paper. Thus, three lines 20 (each 5 millimeters wide) are applied to the cigarette paper 14' leaving four untreated spaces 22 (each 3 millimeters wide). The outermost spaces serve as the pasting area and are overlapped during the forming of the cigarette cylinder.

In accordance with another feature of the invention I have found that by the addition of certain types of additives to the above silicate solutions an improved cigarette can be achieved. Such improvements have been referred to above in the Summary of the Invention.

These improvements are achieved by the addition to the above-described silicate solution of either or both of (a) one or more soluble or dispersible carbohydrates or (b) one or more soluble acids or acidic compounds or liquid alumina gel. The addition of these additives has certain limitations. First, they must not give off vapors (when pyrolysed by the burning cigarette) that are toxic, carcinogenic or noxious. They must not cause precipitation of the silicate.

The functions of the soluble or dispersible carbohydrates are to impart: (a) flexibility, (b) nonwicking and (c) non-sticking (tackiness) properties to the silicate lines or dots.

The functions of the acids or acidic compounds are to (a) modify the taste or flavor of the smoke, (b) leave less residual mouth odors for the smoker, and (c) present a better appearance to the treated cigarette (the lines or dots are less visible).

Among the soluble or dispersible carbohydrates applicable in this invention are sugars (sucrose, dextrose, lactose, levulose, fructose, maltose, etc.), starches, gums and resins which are soluble or dispersible in water (dextrin, cornstarch, potato starch, pectin, carboxymethyl cellulose, agar, gum arabic, sorbitol, etc.).

The applicable acids are preferably the weak acids which have a lesser tendency to precipitate the silicate than strong acids. These include citric, tartaric, acetic, formic, propionic, glycollic, butyric, etc.

When adding weak soluble acids or dispersible colloids to silicate solutions, they should preferably be added to water first and dissolved or dispersed therein and then added to the silicate solution and uniformly mixed.

The addition of small amounts of alumina gel (containing 9% of $Al_2O_3$ by weight), increases the free burning time without affecting the fire resistance.

Since the silicate solutions of this invention are based on the use of soluble concentrated commercial silicates to which various amounts of water are added, it is to this added water to which the additives are added.

The typical commercial type of concentrated silicate which I employ has the following composition:

| | |
|---|---|
| $SiO_2$ | 29.50% |
| $Na_2O$ | 9.20% |
| $H_2O$ | 61.30% |
| | 100.00% |

To 100 parts (by volume) of the above concentrate I add 65 parts by volume of water. The acids, sugar or other carbohydrates are added to this water and dissolved or dispersed therein and this is then added to the concentrated silicate and uniformly mixed before use.

A typical example, using citric acid as the weak acid is as follows:

100 parts (by volume) of the above concentrated silicate, 65 parts (by volume) of water to which is added about 0.25 to about 1.75 grams of citric acid. This is then added to the silicate solution. The citric acid upper limit is about 1.75 grams with this concentration of silicate and the lower limit is about 0.15 grams. Amounts above 1.75 grams tend to precipitate the silicate.

Instead of citric acid I can use tartaric acid, wherein the upper limmit is about 2.25 grams and the lower limit about 0.15 grams.

Instead of citric or tartaric acid I can use glacial acetic acid wherein the upper limit is about 2.5 mls. and the lower limit about 0.15 mls. The limits of acid additive vary in proportion to the amount of $SiO_2$ in the silicate solution.

It is preferred to use those acid additives which have some degree of fire resistance, such as for example, phosphoric acid, tungstic acid and boric acid. A preferred application would involve 100 milliliters of the concentrated silicate discussed above, 75 milliliters of water and 2.5 milliliters of 85 percent phosphoric acid. The phosphoric acid is added to the water until it is thoroughly mixed. The mixed solution is then applied to the cigarette using three 5 millimeter wide lines separated by three 3 millimeter wide spaces, the lines being parallel and running the entire length of the cigarette. After the application of the lines the wet silicate is dried.

When the upper limits of these acids are used, the appearance of the silicate deposits on the cigarette paper are less visible than when no acid or little acid is used. Also the acids modify the taste of the cigarette smoke and the greater the amount of acid the greater the modification of the taste or flavor of the smoke, the particular resultant taste or flavor depending on the acid used. In all cases however, the modification of the flavor removes the tongue or tissue bite associated with the normal cigarette smoke when in contact with the mouth or throat tissues. The acids can be used in the form, for example, of fruit juices such as pineapple, orange, apple, lemon, tomato, etc., which is some cases lend an additional aroma to the smoke. Fruit juices encompass sugars and acids as a double effect.

The sugars and the dispersible carbohydrates in accordance with the invention serve to impart the properties of greater flexibility, non-wicking less hygroscopic silicate lines or dots (non-sticking).

It is preferable to use combinations of acids (or acidic compounds) and sugars or dispersible carbohydrates to impart the combined properties of each, heretofore described.

Most of the cigarette paper in use today is very porous. This is used to increase the speed and heat of combustion and to dilute the smoke stream concentration of "tars," nicotine and gases. Porous paper has the property, however, of blotting or wicking when it is contacted with water. Since the silicate solutions of my invention contain rather large amounts of water, these solutions without sugars or dispersible carbohydrates would cause blotting or wicking on the very thin paper. This in turn would impair its wet strength and make it difficult to manufacture into tightly wound rolls or bobbins, causing the paper to tear in its wet state while in roller tension. Adding the materials of this invention to keep the silicate solution from wicking, eliminates this problem.

Silicate solutions when applied to the cigarette paper and then dried, have a tendency to pick up moisture from humid air. This pick up of moisture makes the silicate sticky. When this condition happens in a pack of cigarettes, the cigarettes would tend to stick together and therefore become difficult to withdraw from their packages. Adding the sugars and or dispersible carbohydrates to the silicate solution prevents this by tying up some of the water in the silicate solution.

When applying silicate solutions to cigarette paper and then drying the silicate, the final appearance shows a contrast between the color of the lines (and dots) and the white untreated spaces. When the maximum amounts of weak acid are incorporated into the silicate solution (short of causing silicate precipitation), the contrast lessens considerably and gives the cigarette a better cosmetic appearance. Also the addition of the acids lowers the pH value of the alkaline silicate solution, thus releasing less alkalinity into the smoke stream.

An example of using a dispersble colloid as an additive involves using 100 parts by volume of the concentrated commercial silicate described above and 65 parts by volume of water. Five grams of potato starch is then added to the 65 parts of water and thoroughly dispersed therein. This dispersion is then added to the concentrated silicate and thoroughly mixed. The final mixture is then applied to the cigarette as is described above.

In place of the potato starch above, I can use corn starch, sodium alginate, pectin or other colloids. Colloids have the property of typing up some of the water of the silicate solution, resulting in more flexibility of the silicate lines (or dots) less wicking of the silicate solution on the cigarette paper, less acrid smoke and less sticking or blocking of the cigarette paper on the bobbin and in the made up pack of cigarettes.

The amount of colloid as added to the water of the silicate solution is variable since the various colloids react in different degrees with water. The upper limit should be that amount which when added to the silicate solution results in a fluid mixture short of gelling.

It is to be understood that of the many additives such as sugars, colloids, acids, etc., that can be added to the silicate solutions, the actual choice should be based on the reaction of the particular compound with the heat of the burning cigarette (about 900° C) with respect to toxicity, carcinogenic effects, toxic effects and noxious effects of the resultant vapors on the smoker.

Various types of soluble or dispersible flavorants or odorants which are compatible in a silicate solution may be added to modify the flavor or taste.

It is noted that included in the above-described additives are the humectants glycerine and sorbitol. Liquid glycerine is preferred over powdered sorbitol as the humectant. The addition of glycerine to a concentrated silicate solution of the type described above has the property of expanding the upper and lower limits of the $SiO_2$ and water.

Treating a regular cigarette (with a burning rate of 5 millimeters per minute) with a silicate solution of the following composition, yields a burning rate of about 1.5 to 2.0 millimeters per minute:

| | % by WT. | |
|---|---|---|
| $SiO_2$ | — | 16.857 |
| $Na_2O$ | — | 5.257 |
| $H_2O$ | — | 77.886 |
| $Al_2O_3$ | — | 00.014 |
| | | 100.00 |

This small addition of alumina gel containing 9% of $Al_2O_3$ increased the free burn time (not the rate) from about 5 to 7 minutes, before self-extinguishment takes place, yet without affecting the fire resistance. The cigarette was treated as follows with the above solution:

3 - 4.5 millimeter wide lines separated by 3 - 4.0 millimeter wide spaces, running the length of the cigarette. This is equivalent to covering the paper area with about 53% of the above silicate solution, leaving 47% of untreated areas (spaces between the lines.)

Larger amounts of alumina gel which could increase the free burning time to about 10 minutes may be used wherein the $Al_2O_3$ content of the entire solution is, for example 0.25% by weight. Larger amounts than this are only wasteful.

Alumina gel is not soluble in the silicate solution. It is dispersible and the solution containing it must be thoroughly agitated to insure uniform suspension when it is being applied to the cigarette paper (wrapper). It should first be dispersed in water and then added to the concentrated silicate.

Self-extinguishing is, in fact, the main key to the invention. There are, however, two phases of self-extinguishing. The important one is the ability to self-extinguish when in contact with a surface. The other phase, which is for the convenience of the smoker, is the length of burning time between puffs, in air. There are two areas that are responsible for a longer burn time between puffs. The one related to the addition of alumina gel described above. The other area is related to the use of 5 to 7 lines and spaces wherein the lines are made of silicate containing from about 19.5 to 22.5% of $SiO_2$ and the spaces are coated with dilute solutions of liquid silicate containing about 5.7% to about 10.2% $SiO_2$.

The widths of lines and spaces range from about 2.5 millimeters for the five lines and spaces to about 1.8 millimeters for the seven lines and spaces.

The silicate concentrations in the spaces are very low (5.7 to 10.2%) and the water concentrations are high 86.18 to 92.6%. This makes for wicking on the cigarette paper. To overcome this there are two methods:

1. Coat the entire paper with the low $SiO_2$ concentrations and dry — then apply the lines of silicate containing 19.5 to 22.5% $SiO_2$.

2. Apply the lines first (19.5 to 22.5% $SiO_2$) and dry — then coat the spaces or the entire paper with the silicate containing 5.7 to 10.2% of $SiO_2$.

Another feature of the invention is that by using the coating in accordance with the invention which results in the slow burning rate of the cigarette between puffs, it is possible to make a cigarette with a substantially longer filter portion. Thus, a typical 85 millimeter long filter cigarette, which is the standard length, can be made, by employing the silicate coating in accordance with the invention, with a 55 millimeter long filter and a 30 millimeter long tobacco rod. This cigarette would give the same amount of puffs out of the 30 millimeter long tobacco rod as the regular cigarette gets out of its 60 millimeter long tobacco rod with a 25 millimeter filter tip portion. The puff rate is 1 per minute and is based on the standard Federal Trade Commission method for testing of cigarettes.

Figure 3:
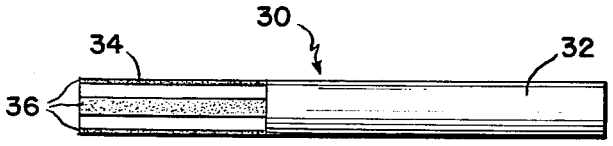
FIG. 3 is a view showing an alternate form of cigarette construction in accordance with the invention.

The cigarette in accordance with this form of the invention is shown in FIG. 3 wherein the cigarette is indicated at 30 and comprises a long filter tip 32 and a short tobacco rod 34 provided with coating lines 36.

The long filter tip may contain tobacco as its filtering agent. When the tipping paper (which contains filtering tobacco or other types of filter material) is as long as the filter area, it will stop the cigarette from burning when the burning coal burns up to the beginning of the tipping paper. Also this area may contain nothing. While it will not result in better filtration, it will keep the hot last puffs quite a distance from the smoker's mouth, which is desirable.

Because of the ability to employ a long filter in the cigarette 30 in accordance with the invention a number of important results can be achieved. For example, less tars, nicotine and gases will be produced. Moreover, it is well known that the last few puffs of a cigarette are the most dangerous because of the high mouth temperature smoke resulting in a harsh taste and a burning sensation in the throat and in the oral tissues and because of the high concentration of tars, nicotine and gases. Because of the long filter in accordance with the cigarette of the invention, the harm caused by these last few puffs is eliminated.

The use of a long filter also makes it possible to incorporate various types of filtering material into the filter, such as much larger amounts of activated charcoal for adsorption of the gases.

An example of a cigarette employing the long filter in accordance with the invention involves a cigarette made with a filter length of 55 millimeters and a tobacco rod length of 30 millimeters. The outside of the cigarette wrapper is treated with a solution made up of 100 parts by volume of a concentrated silicate solution comprising 29.5 percent $SiO_2$, 9.2 percent $Na_2O$ and 61.3 percent $H_2O$ (the specific gravity at 25° C being 1.41). To this silicate solution is added 75 parts by volume of water with or without the additives discussed above. This mixture is then applied to the outside of the cigarette wrapper along three lines 4 millimeters wide, the lines being straight and parallel to one another with three spaces 4 millimeters wide therebetween. The lines are applied only on the exterior of the 30 millimeter long tobacco rod. The wet silicate is then dried and the cigarette is ready to be smoked.

I claim:

1. In a cigarette having a body of tobacco enclosed by a combustible wrapper, a heat insulating coating on said wrapper making the cigarette self-extinguishing when in contact with a surface, said coating being deposited from an aqueous solution of a soluble alkali silicate containing from about 17 to 27 percent by weight of $SiO_2$, the coating area of the silicate solution on the wrapper being from about 40 to 84 percent of the entire wrapper area to produce a cigarette which is self-extinguishing when in contact with a flammable or other surface, said coating area being generally evenly distributed along the length of the wrapper to reduce the burning rate of the wrapper throughout its length and to limit the air access to the burning tobacco throughout the length of the wrapper.

2. A cigarette according to claim 1 wherein said coating is provided with a silicate concentration and is arranged on the wrapper so that the burning rate of the cigarette, without puffing, is within the range of from about 0.7 to about 3.5 millimeters per minute.

3. A cigarette according to claim 2 wherein said silicate solution has added thereto an acid, the maximum amount of acid being that amount which is just short of causing the silicate solution to precipitate.

4. A cigarette according to claim 3 wherein said acid is a weak acid selected from the group including citric, tartaric, acetic, formic, propionic, glycolic, and butyric.

5. A cigarette according to claim 2 wherein said silicate solution has added thereto a carbohydrate.

6. A cigarette according to claim 5 wherein said carbohydrate includes soluble sugars, gums and resins selected from a group including sucrose, dextrose, lactose, levulose, fructose, maltose, dextrin, cornstarch, potato starch, pectin, carboxymethyl cellulose, agar, gum arabic and sorbitol.

7. A cigarette according to claim 2 wherein said silicate solution has added thereto a colloid.

8. A cigarette according to claim 7 wherein said colloid is from a group including potato starch, cornstarch, sodium alginate and pectin.

9. A cigarette according to claim 2 wherein said silicate solution has added thereto a humectant.

10. A cigarette according to claim 9 wherein said humectant is from a group including glycerine and sorbitol.

11. A cigarette according to claim 2 wherein said silicate solution has added thereto a small amount of a fire retardent compound.

12. A cigarette according to claim 1 wherein said coating is applied to said wrapper along lines extending longitudinally along the cigarette, there being provided from two to six lines which are 2 to 8 millimeters wide spaced apart from 1 to 6.5 millimeters.

13. A cigarette according to claim 12 wherein said lines are approximately uniformly spaced from one another.

14. A cigarette according to claim 12 wherein said lines are sinuous in configuration but does not extend more than 45° relative to a longitudinal straight line along the wrapper.

15. A cigarette according to claim 12 wherein the spaces between the lines are coated with deposits from a dilute silicate solution containing from about 5.7 to 10.2 percent by weight of $SiO_2$.

16. A cigarette according to claim 1 including a filter tip at one end of the cigarette, said filter tip being substantially longer than the tobacco containing portion of the cigarette.

17. A cigarette according to claim 1 wherein said silicate solution has added thereto a liquid alumina gel.

18. A cigarette according to claim 17 wherein said alumina gel is added to the silicate solution in an amount such that the $Al_2O_3$ content of the entire solution is less than about 0.25% by weight.

* * * * *